US011583745B2

(12) United States Patent
Kolloff

(10) Patent No.: US 11,583,745 B2
(45) Date of Patent: Feb. 21, 2023

(54) GOLF SWING PLANE TRAINING AID DEVICE

(71) Applicant: Adam Kolloff, Lexington, MA (US)

(72) Inventor: Adam Kolloff, Lexington, MA (US)

(73) Assignee: Adam Kolloff, Lexington, MA (US)

( * ) Notice: Subject to any disclaimer, the term of this patent is extended or adjusted under 35 U.S.C. 154(b) by 143 days.

(21) Appl. No.: 17/219,144

(22) Filed: Mar. 31, 2021

(65) Prior Publication Data

US 2021/0316201 A1 Oct. 14, 2021

Related U.S. Application Data

(60) Provisional application No. 63/006,941, filed on Apr. 8, 2020.

(51) Int. Cl.
*A63B 69/36* (2006.01)

(52) U.S. Cl.
CPC ..... *A63B 69/3621* (2020.08)

(58) Field of Classification Search
CPC ..... A63B 69/36; A63B 69/3621; A63B 57/10; A63B 2071/024; A63B 2071/026; A63B 2225/09
USPC ..... 473/218, 219, 223, 226, 231, 233, 238, 473/242, 257–261, 244, 247, 314, 473/271–278
See application file for complete search history.

(56) References Cited

U.S. PATENT DOCUMENTS

| | | | | |
|---|---|---|---|---|
| 7,901,295 | B1 * | 3/2011 | Bush, III | A63B 69/3621 473/218 |
| 9,833,681 | B1 * | 12/2017 | Leitz | A63B 69/3621 |
| 11,458,379 | B1 * | 10/2022 | Leskiff | A63B 69/3621 |
| 2013/0178302 | A1 * | 7/2013 | Shahi | A63B 69/3667 473/409 |

FOREIGN PATENT DOCUMENTS

| | | | | |
|---|---|---|---|---|
| GB | 2514129 | A * | 11/2014 | A63B 69/36 |

* cited by examiner

*Primary Examiner* — Nini F Legesse
(74) *Attorney, Agent, or Firm* — Ron Penaflor

(57) ABSTRACT

The present disclosure relates to a portable golf swing plane training device having a base support, alignment rods, and a golf club insert member for receiving a golf club. The golf club, when applied to the golf club insert member, acts as a weight and support member to stabilize and firmly hold the portable golf swing plane training device to a golf playing surface.

20 Claims, 15 Drawing Sheets

101

GOLF SWING PLANE TRAINING AID DEVICE

RELATED APPLICATIONS

This application claims the benefit of priority of U.S. Provisional Application Ser. No. 63/006,941 filed Apr. 8, 2020, which is hereby incorporated by reference in its entirety.

FIELD OF THE DISCLOSURE

The present disclosure relates to a golf training device. Particularly, the golf training device is a golf swing plane training device having a golf club insert member for receiving a golf club. The golf club, when applied to the golf club insert member, stabilizes and firmly holds the golf swing plane training device to a golf playing field or golf training platform.

BACKGROUND

Golf training aids are widely available and often useful tools for helping golfers improve the golf swings and techniques. However, when golfers practice on their own at the driving range, they often fail to make progress because the lack feedback. Without proper feedback, they will continue to reinforce bad golf training habits. A common and undesirable habit many golfers face is having an improper golf stroke and swing plane, which can cause several faults such as a slice, hook, shank, as well as poor golf swing techniques. There are many golf training aid devices on the market that can help golfers with teaching them proper swing plane techniques. However, most of these golf training aid devices are too large, heavy, require too much equipment, or not portable. Therefore, it would be highly desirable to have a small, lightweight, and extremely easy-to-use golf training aid device with minimal equipment that a golfer could easily take with them to the golf driving range to improve their golf swing.

SUMMARY

It is an advantage of the present disclosure to provide a golf swing plane training aid device for use on a golf playing surface including a base support having a first swing arm support member, a second swing arm support member, a cross-bar member coupling a first end of the first swing arm support member to a first end of the second swing arm support member, a golf club insert member coupling a second end of the first swing arm support member to a second end of the second swing arm support member, and a pivoting swing arm member disposed between a gap separating the first swing arm support member from the second swing arm support member. The pivoting swing arm member may have a primary slot disposed on a first end of the pivoting swing arm member. The golf club insert member may also have channel members for receiving a golf club. The golf club, when applied to the channel members, is configured to stabilize and hold the golf swing plane training aid device to the golf playing surface. Still, the golf swing plane training aid device may have a primary alignment rod detachably coupled to the primary slot of the pivoting swing arm member.

It is another advantage of the present disclosure to provide a golf swing plane training aid device for use on a golf playing surface including a base support having a first swing arm support member, a second swing arm support member, a cross-bar member coupling a first end of the first swing arm support member to a first end of the second swing arm support member, a golf club insert member coupling a second end of the first swing arm support member to a second end of the second swing arm support member, and a pivoting swing arm member disposed between a gap separating the first swing arm support member from the second swing arm support member. The pivoting swing arm member may include a primary slot disposed on a first end of the pivoting swing arm member. The golf club insert member may include a golf clubface channel member for receiving a clubface of a golf club. The golf club, when applied to the golf clubface channel member, is configured to stabilize and hold the golf swing plane training aid device to the golf playing surface. In addition, the golf swing plane training aid device may include a primary alignment rod detachably coupled to the primary slot of the pivoting swing arm member.

These and other objects, features and advantages of the present disclosure will become more apparent in light of the following detailed description of preferred embodiments thereof, as illustrated in the accompanying drawings.

BRIEF DESCRIPTION OF THE DRAWINGS

The present disclosure will be more clearly understood from the following detailed description of the preferred embodiments of the disclosure and from the attached drawings, in which.

In the appended figures, one or more elements may have the same reference numeral in different figures indicating previously described.

DETAILED DESCRIPTION

Figure 1:
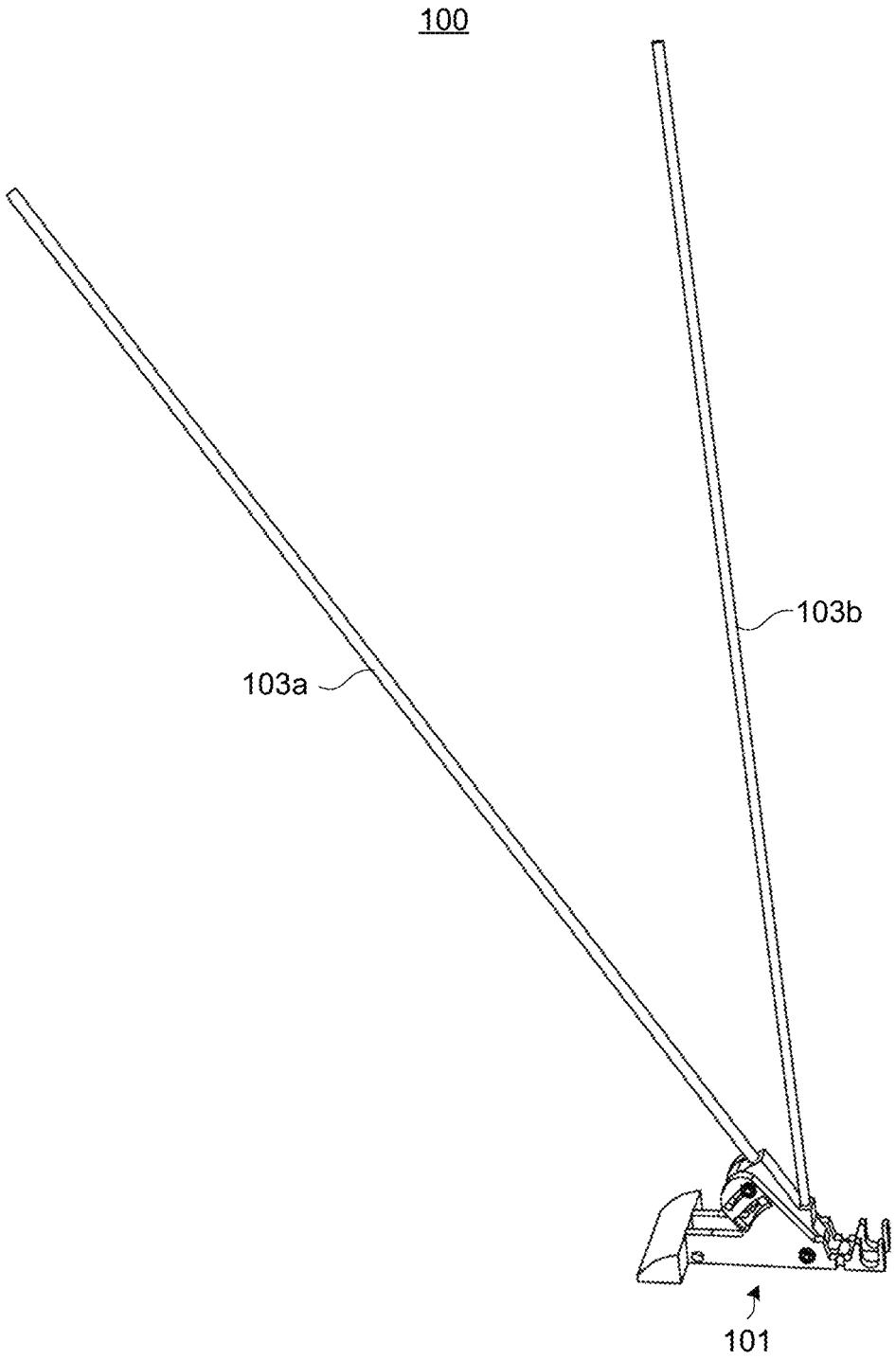
FIG. 1 illustrates a golf swing plane training aid device that provides a golfer swing plane feedback, in accordance to an embodiment.

FIG. 1 illustrates a golf swing plane training aid device 100 that provides a golfer swing plane feedback, in accordance to an embodiment. The swing plane training device 100 includes a base support 101, a primary alignment rod 103*a*, and a secondary alignment rod 103*b*.

Figure 2:
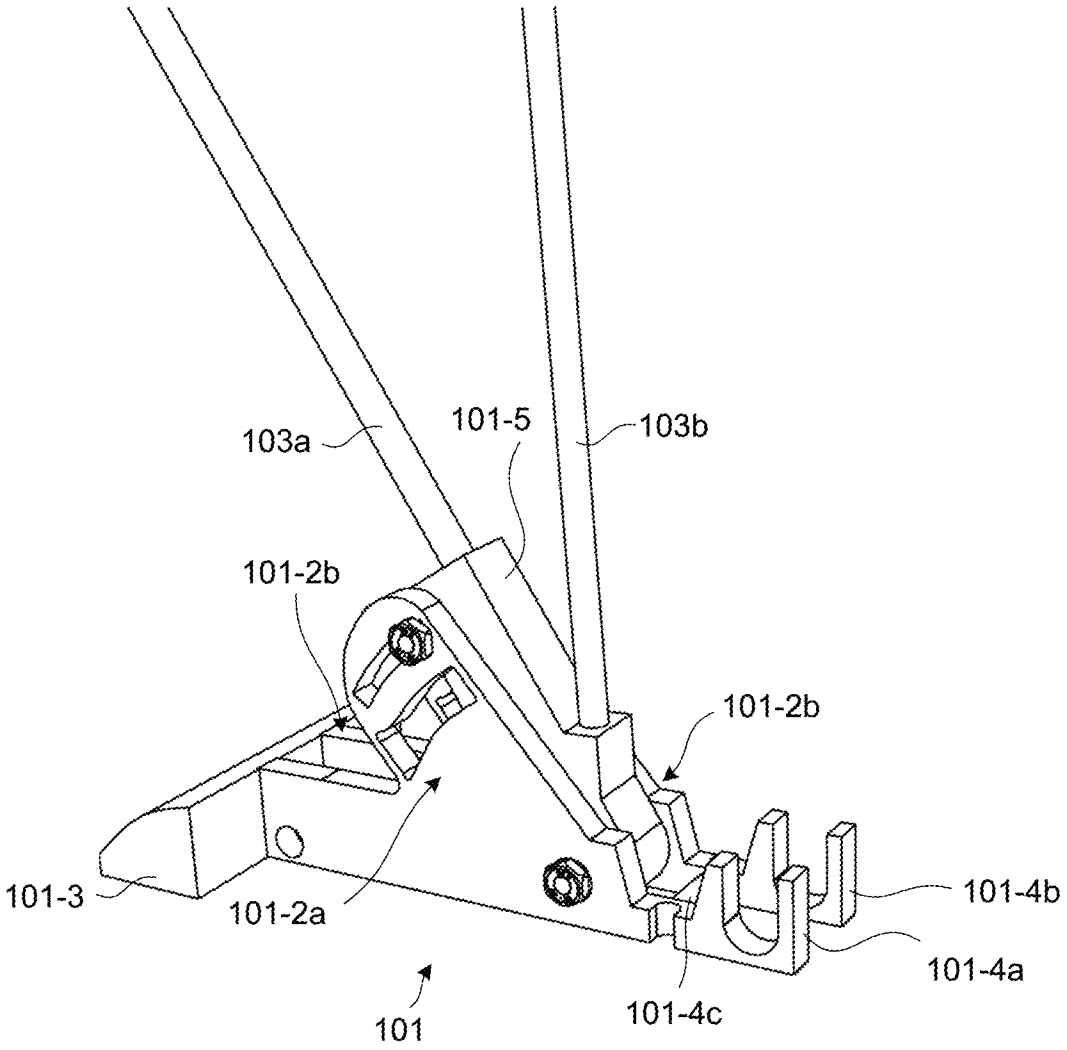
FIG. 2 illustrates a close up and detail view of the base support 101 and alignment rods, in accordance to an embodiment.

FIG. 2 illustrates a close up and detail view of the base support 101 and alignment rods (103*a*, 103*b*). The base support 101 may include a first swing arm support member 101-2*a*, a second swing arm support member 101-2*b*, a cross-bar member 101-3 coupling a first end of the first swing arm support member 101-2*a* to a first end of the second swing arm support member 101-2*b*, a golf club insert member (101-4*a*, 101-4*b*, 101-4*c*) coupling a second end of the first swing arm support member 101-2*a* to a second end of the second swing arm support member 101-2*b*, and a pivoting swing arm member 101-5 disposed between the first swing arm support member 101-2*a* and the second swing arm support member 101-2*b*.

Figure 3A:
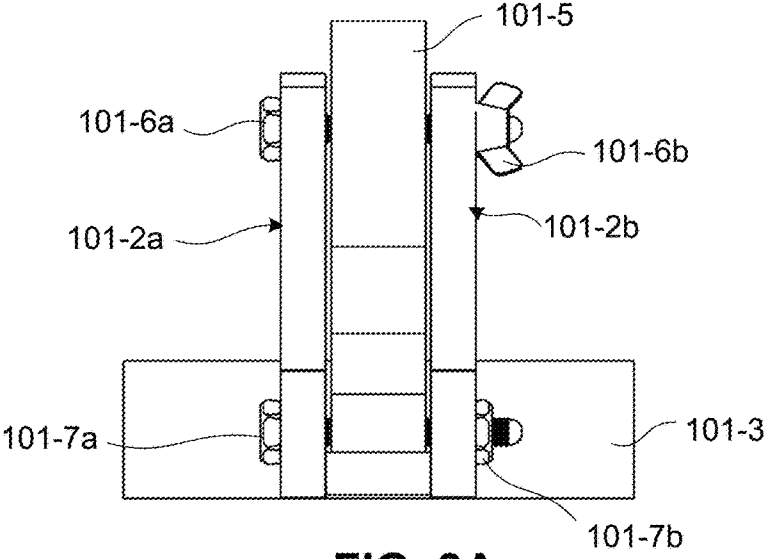
FIG. 3A-FIG. 3D illustrate a front, top, side, and perspective views, respectively, of the base support in accordance to an embodiment.
Figure 3B:
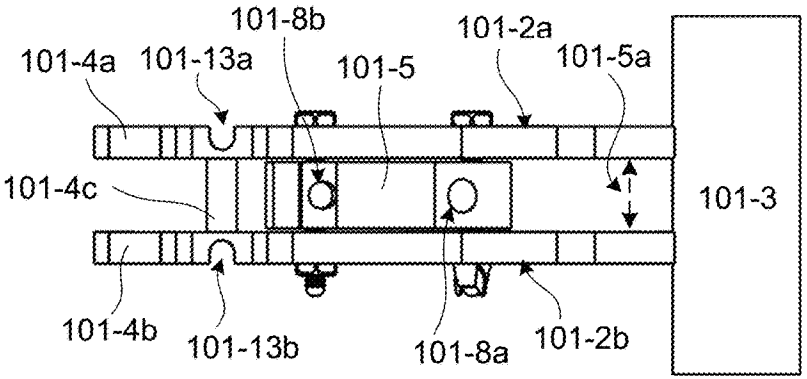
Figure 3C:
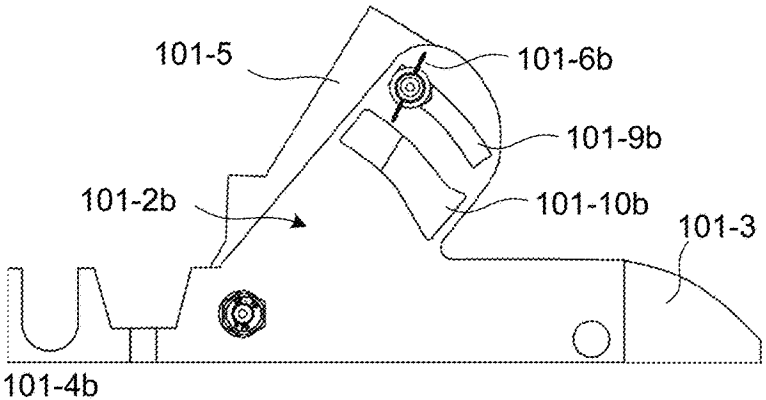
Figure 3D:
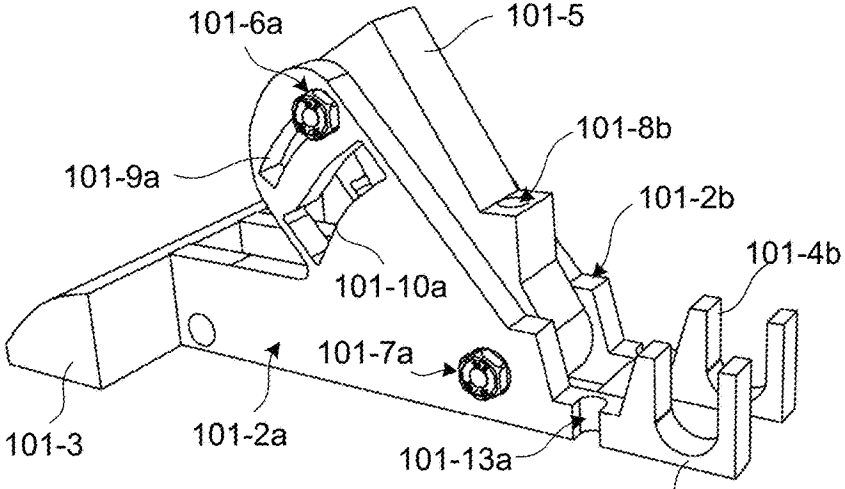

FIG. 3A-FIG. 3D illustrate a front, top, side, and perspective views, respectively, of the base support 101 in accordance to an embodiment. As shown in FIG. 3A (front view), the pivoting swing arm member 101-5 may be fastened and secured to the swing arm support members (101-2*a*, 101-2*b*) via swing adjustment fasteners (101-6*a*, 101-6*b*) and pivot fasteners (101-7*a*, 101-7*b*), which may include fasteners such as threaded bolts, wing nuts, threaded screws, carriage bolts, socket screws, hex bolts or other types of threaded nuts and bolts. As shown in FIG. 3B (top view), the golf club insert member may include two channels (101-4*a*, 101-4*b*) coupled by a channel bar 101-4*c*. In one implementation, the two channels (101-4*a*, 101-4*b*) may each be open-ended or u-shaped as shown in FIG. 3D. The pivoting swing arm member 101-5 may be disposed between a gap 101-5*a* separating the first swing arm support member 101-2*a* from the second swing arm support member 101-2*b*. In addition, the pivoting swing arm member 101-5 may include a primary slot 101-8*a* and a secondary slot 101-8*b* into which the primary alignment rod 103*a* and the secondary alignment rod 103*b* are inserted, respectively. In practice, both the primary alignment rod 103*a* and the secondary alignment rod 103*b* are not permanently attached to the slots (101-8*a*, 101-8*b*) so that they can be easily removed or inserted into the slots by the golfer when performing specific golf swing aid training techniques. In addition, the base support 101 may include tee slots (101-13*a*, 101-13*b*) disposed between the golf club insert member (101-4*a*, 101-4*b*, 101-4*c*) and the swing arm support members (101-2*a*, 101-2*b*). In one implementation, the tee slots (101-13*a*, 101-13*b*) may be open-ended or u-shaped slot as shown in FIG. 3B. In another implementation, the tee slots (101-13*a*, 101-13*b*) may be circular shaped or square-shaped. As shown in FIG. 3C (side view) and FIG. 3D (perspective view), the swing arm support members (101-2*a*, 101-2*b*) may each include a primary swing adjustment slot (101-9*a*, 101-9*b*) and a secondary swing slot (101-10*a*, 101-10*b*). In one implementation, both the primary swing adjustment slot (101-9*a*, 101-9*b*) and secondary swing slot (101-10*a*, 101-10*b*) are generally rectangular in shape having a slight arc or bend.

Figure 4:
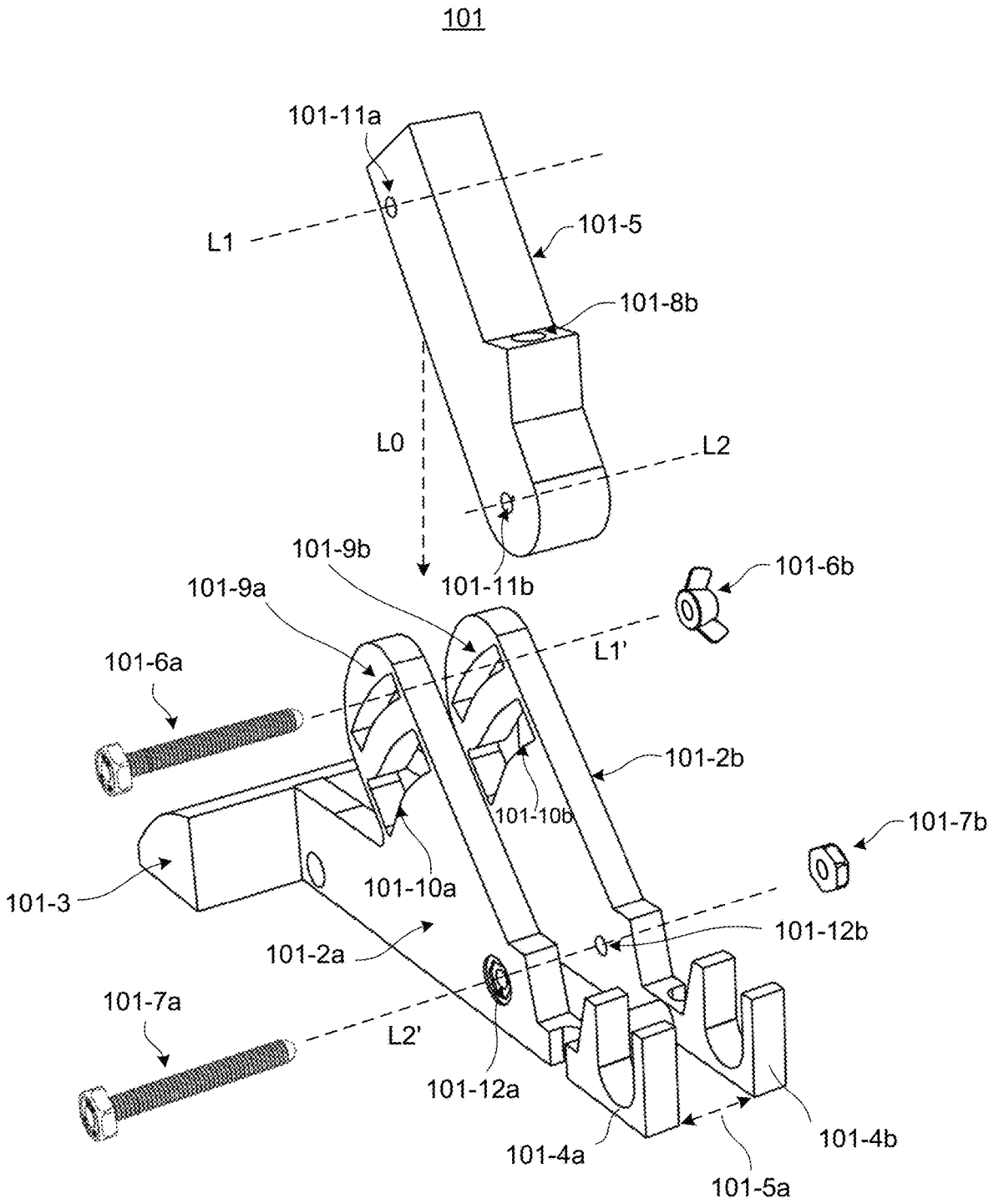
FIG. 4 illustrates an exploded view of the base support in accordance to an embodiment.

FIG. 4 illustrates an exploded view of the base support 101 in accordance to an embodiment. In the exploded view, the pivoting swing arm member 101-5, swing adjustment fasteners (101-6*a*, 101-6*b*), and pivot fasteners (101-7*a*, 101-7*b*) are separated from the swing arm support members (101-2*a*, 101-2*b*), providing additional views of hidden components. The pivoting swing arm member 101-5 may include a primary hole 101-11*a* disposed near a top portion of the pivoting swing arm member 101-5 and a secondary hole 101-11*b* disposed near a bottom portion of the pivoting swing arm member 101-5. Also in this view, the swing arm support members (101-2*a*, 101-2*b*) may have pivot holes (101-12*a*, 101-12*b*) disposed near a bottom front-side portion of the swing arm support members (101-2*a*, 101-2*b*). In operation, the pivoting swing arm member 101-5 may be inserted in between the swing arm support members (101-2*a*, 101-2*b*) in a downward direction L0 as shown. Once inserted, the primary hole 101-11*a* of the pivoting swing arm member 101-5 is aligned (L1-L1') to the primary swing adjustment slot (101-9*a*, 101-9*b*) while the secondary hole 101-11*b* of the pivoting swing arm member 101-5 is aligned (L2-L2') to the pivot holes (101-12*a*, 101-12*b*) of the swing arm support members (101-2*a*, 101-2*b*). After insertion, the pivoting swing arm member 101-5 is secured to the primary swing adjustment slot (101-9*a*, 101-9*b*) by the swing adjustment fasteners (101-6*a*, 101-6*b*) and further secured to the pivot holes (101-12*a*, 101-12*b*) by the pivot fasteners (101-7*a*, 101-7*b*).

Figure 5:
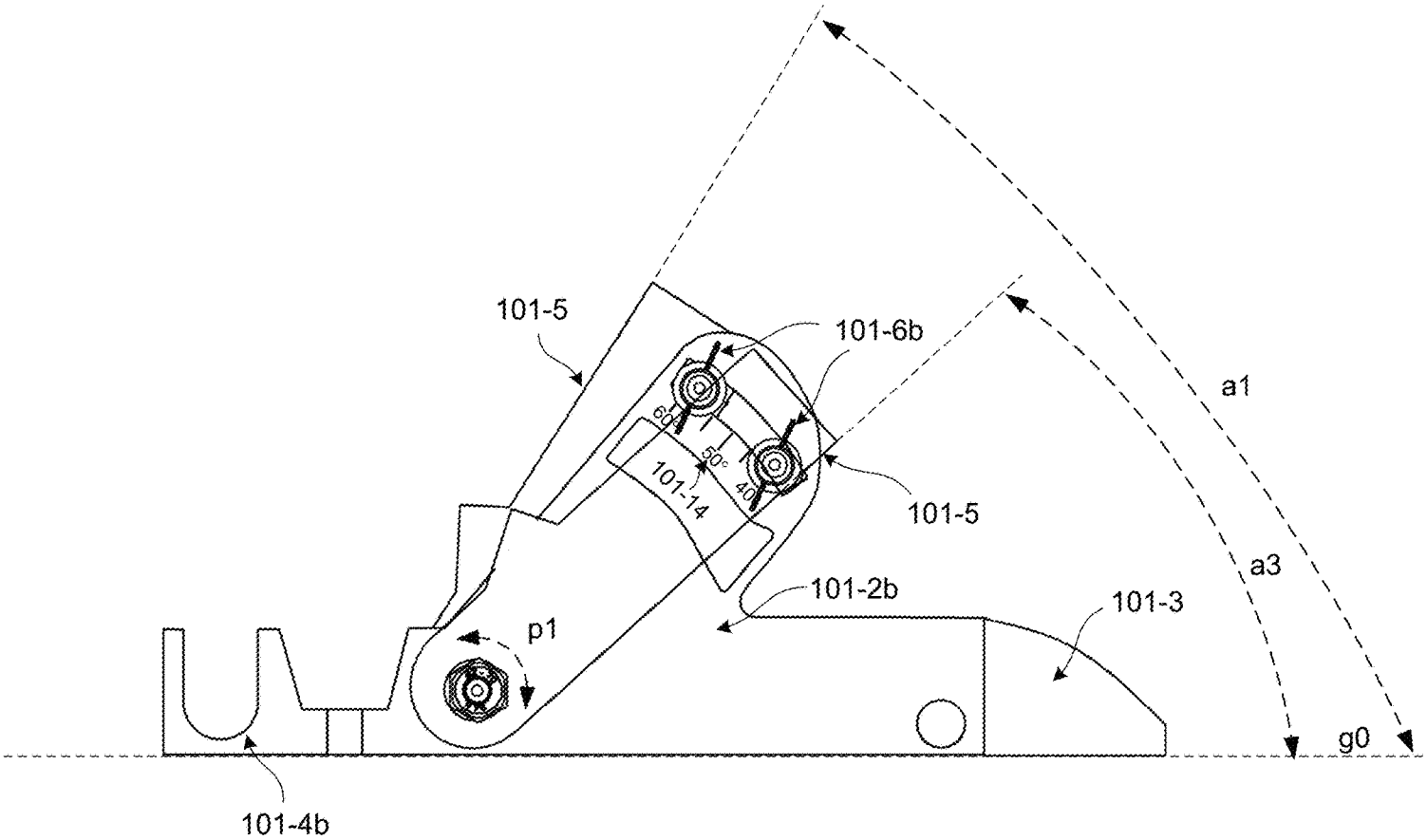
FIG. 5 illustrates a side view of the base support with pivoting swing arm member at different adjustment settings, in accordance to an embodiment.

FIG. 5 illustrates a side view of the base support 101 with pivoting swing arm member 101-5 at different adjustment settings, in accordance to an embodiment. The swing arm support members (101-2*a*, 101-2*b*) may also include indicia 101-14, such as numbers and line markings, indicating the angle range setting (a1-a3) of the pivoting swing arm member 101-5 relative to ground (g0) on which the base support 101 sits. Adjustable angle settings for pivoting swing arm member 101-5 include a range that is approximately between 40-60 degrees. In operation, angle adjustments are made by loosening the swing adjustment fasteners (101-6*a*, 101-6*b*) and then rotating the pivoting swing arm member 101-5 along a pivot point (p1) to the desired angle setting determined by the golfer. Note, the ground (g0) may include various types of golf playing surfaces such as live grass or artificial turf which may be found in golf playing fields, golf courses, golf driving ranges, golf practice fields, or golf training platforms.

Figure 6A:
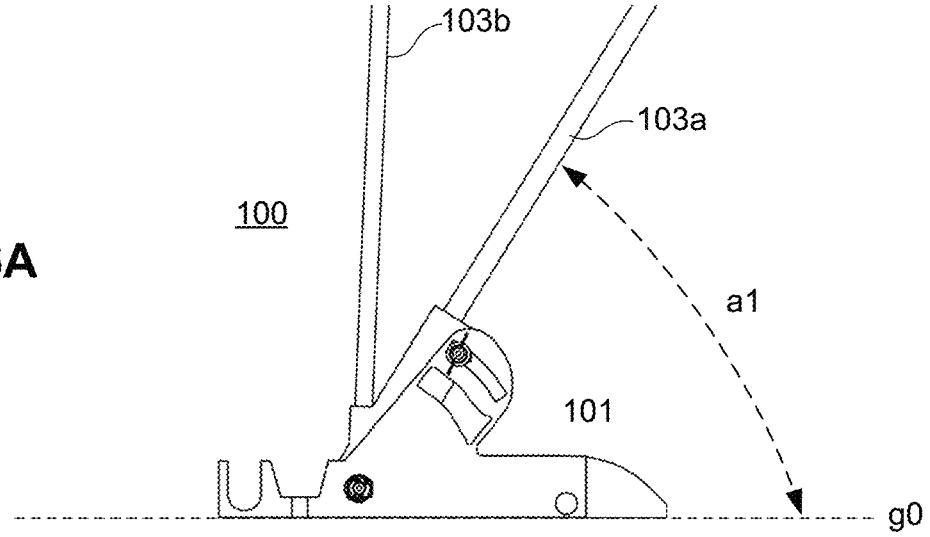
FIG. 6A-FIG. 6C illustrate a side view of the swing plane training device with the primary alignment rod and secondary alignment rod attached at different angle adjustment settings, in accordance to an embodiment.
Figure 6B:
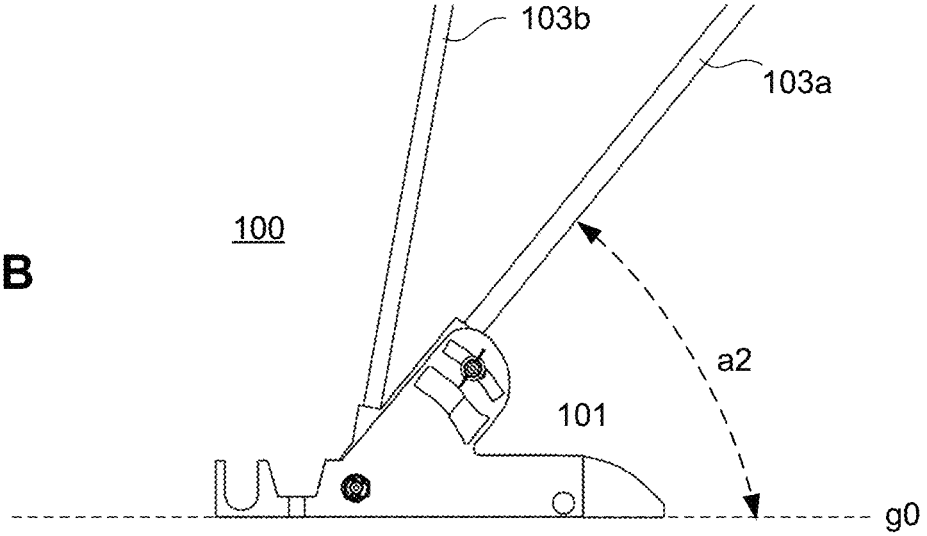
Figure 6C:
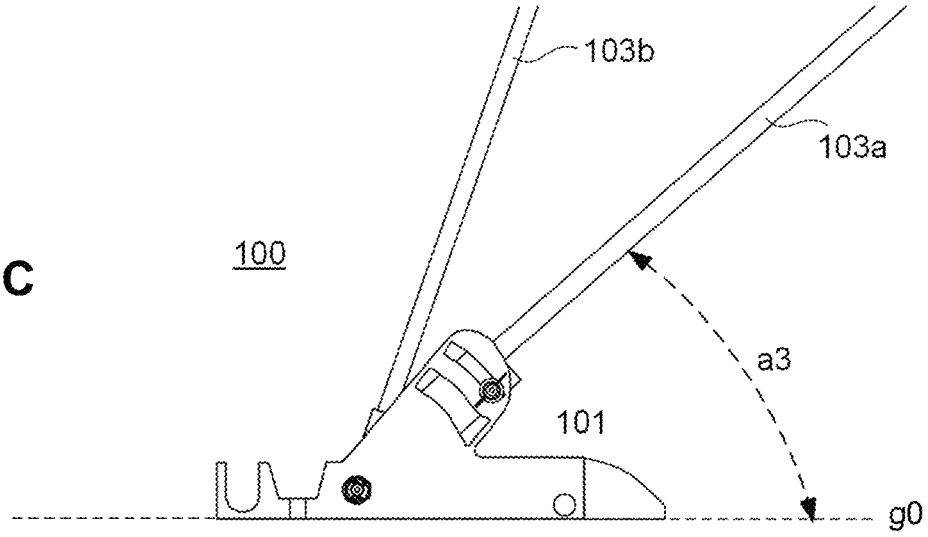

FIG. 6A-FIG. 6C illustrate a side view of the swing plane training device 100 with the primary alignment rod 103*a* and secondary alignment rod 103*b* attached at different angle adjustment settings, in accordance to an embodiment. In FIG. 6A, the swing plane training device 100 is positioned at its maximum angle adjustment setting with the primary alignment rod 103*a* rotated at angle (a1 or approximately 60 degrees) relative to the ground. In FIG. 6B, the swing plane training device 100 is positioned at its mid-point angle adjustment setting with the primary alignment rod 103*a* rotated at angle (a2 or approximately 50 degrees) relative to the ground. In FIG. 6C, the swing plane training device 100 is positioned at its minimum angle adjustment setting with the primary alignment rod 103*a* rotated at angle (a3 or approximately 40 degrees) relative to the ground.

Figure 7:
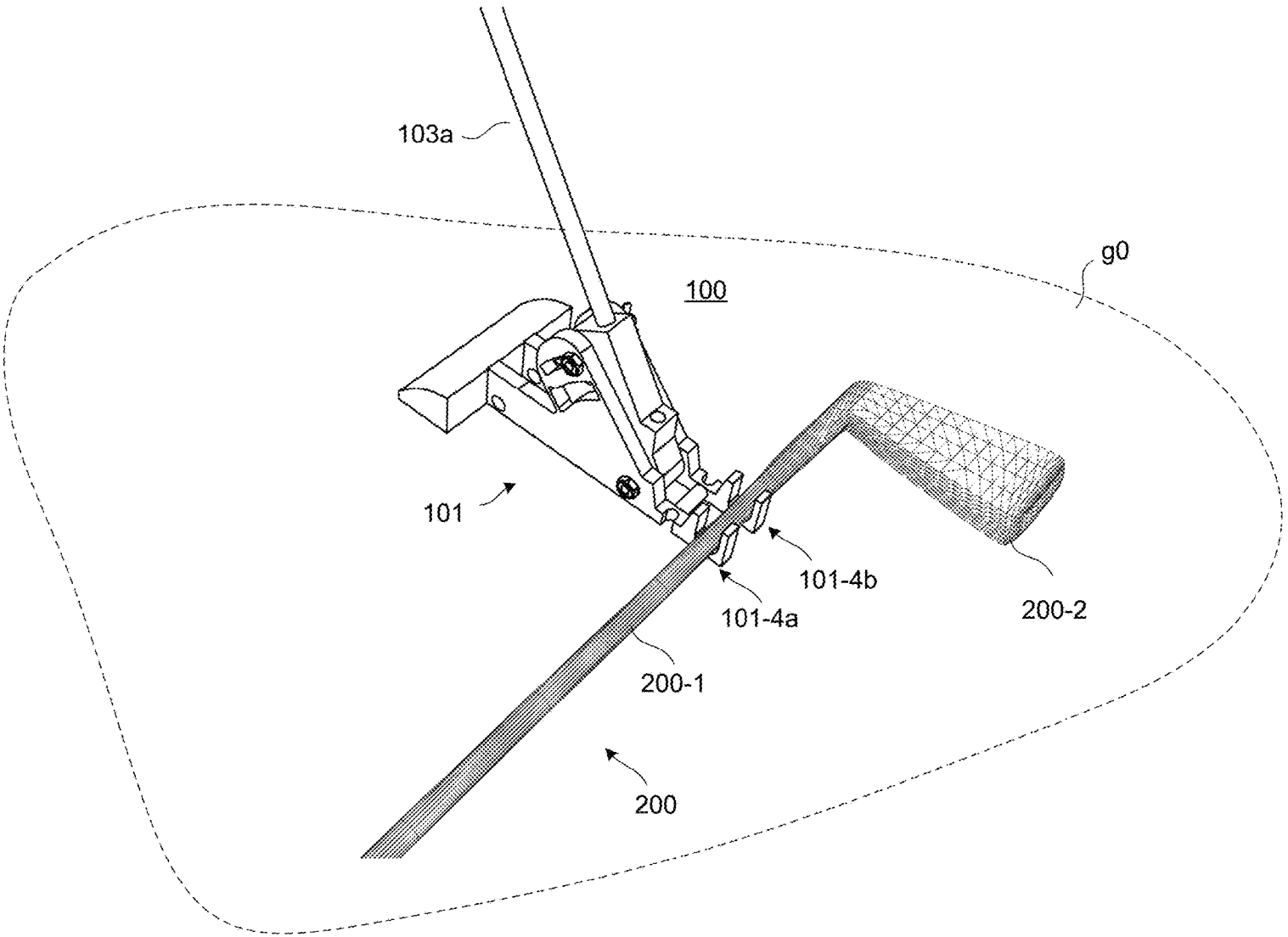
FIG. 7 illustrates a first implementation of adding a golf club as a weight to stabilize and hold the base support.

In practice, the weight and downward force of the primary alignment rod 103*a* and secondary alignment rod 103*b* when applied and inserted into to the base support 101 may destabilize it and cause it to move or tip over. Therefore, in order to stabilize and hold the base support 101 to the ground (g0) a weight may be applied to the golf club insert member (101-4*a*, 101-4*b*, 101-4*c*), adding additional support and stability to the base support 101. FIG. 7 illustrates a first implementation of adding a golf club 200 as a weight to stabilize and hold the base support 101. The golf club 200 may be any type of golf club (woods, irons, hybrids, wedges, putters, etc.) having a shaft 200-1 and clubface 200-2. The shaft member 200-1 near the clubface 200-2 of the golf club 200 may be inserted into the open-end of the golf club insert member (101-4*a*, 101-4*b*, 101-4*c*) with the clubface 200-2 resting flat to the ground (g0).

Figure 8:
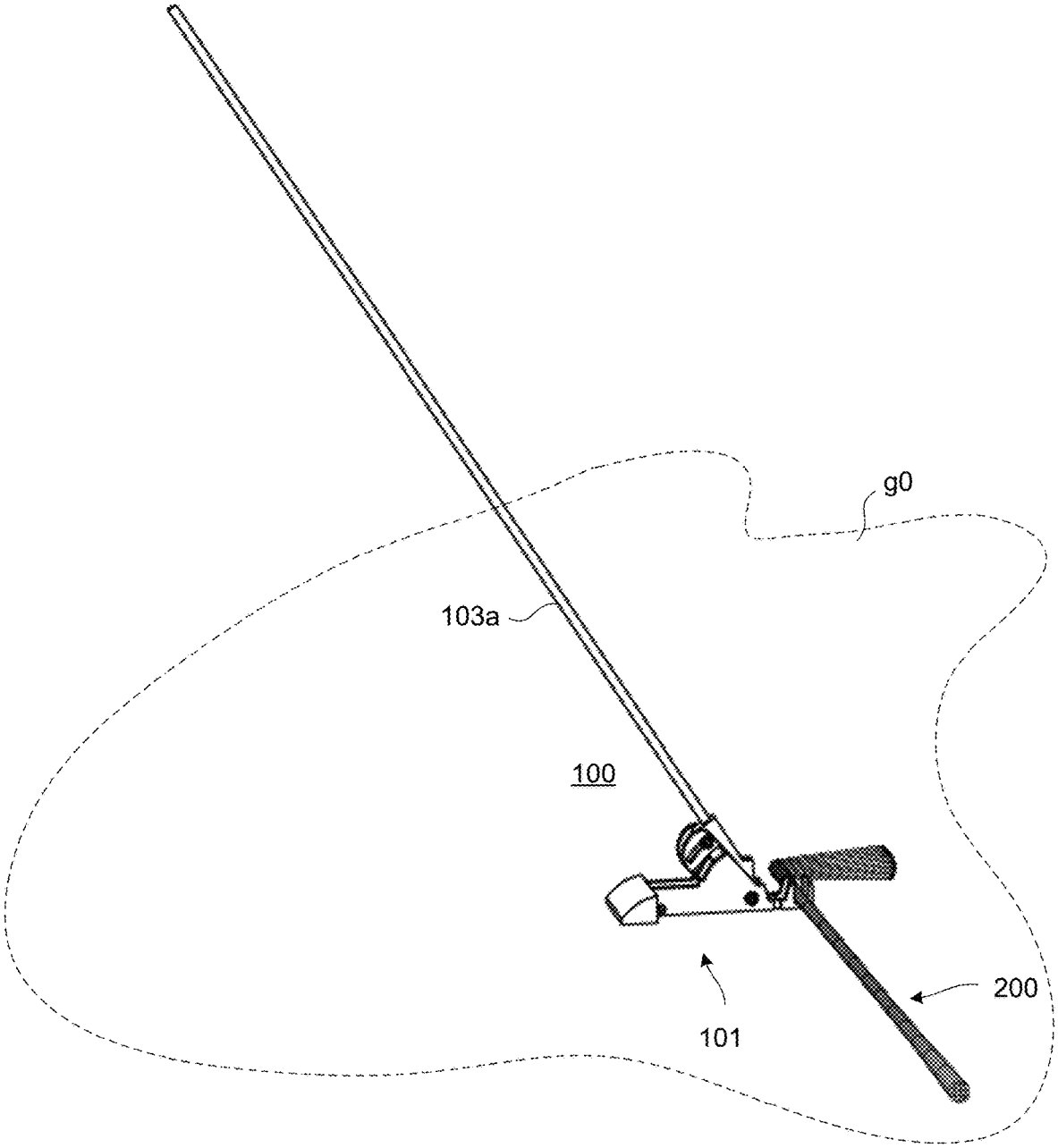
FIG. 8 illustrates a full perspective view of the swing plane training device with the golf club acting as a weight to anchor and stabilize the base support and alignment rods.

FIG. 8 illustrates a full perspective view of the swing plane training device 100 with the golf club 200 acting as a weight to hold and stabilize the base support 101 and alignment rods (103*a*, 103*b*). The key advantages of the swing plane training device 100 includes: 1) it allows the base support 101 to be lighter in weight and therefore easier to carry by the golfer; 2) allows the golfer to use an extra golf club as a weight to firmly hold and keep in place the base support 101; and 3) does not require additional weights or parts for the golfer to carry in their golf bag. In contrast, while other conventional swing plane training aids may provide swing plane feedback, none have features describe hereinabove which provide the golfer a portable, lightweight, simple, and mobile training device solution that golfers can easily take with them to the golf course or driving range. In addition, since the majority of the weight is primarily provided by the golf club 200 instead of the swing plane training device 100, smaller and lightweight designs of the swing plane training device 100 can be realized. In sum, the swing plane training device 100 described in the present disclosure has the advantage of using the golf club 200 as a weight to hold the base support 101 and stabilize the swing plane training device 100, the primary alignment rod 103*a*, and/or the secondary alignment rod 103*b*, allowing the swing plane training device 100 to be portable and lightweight in design.

Figure 9A:
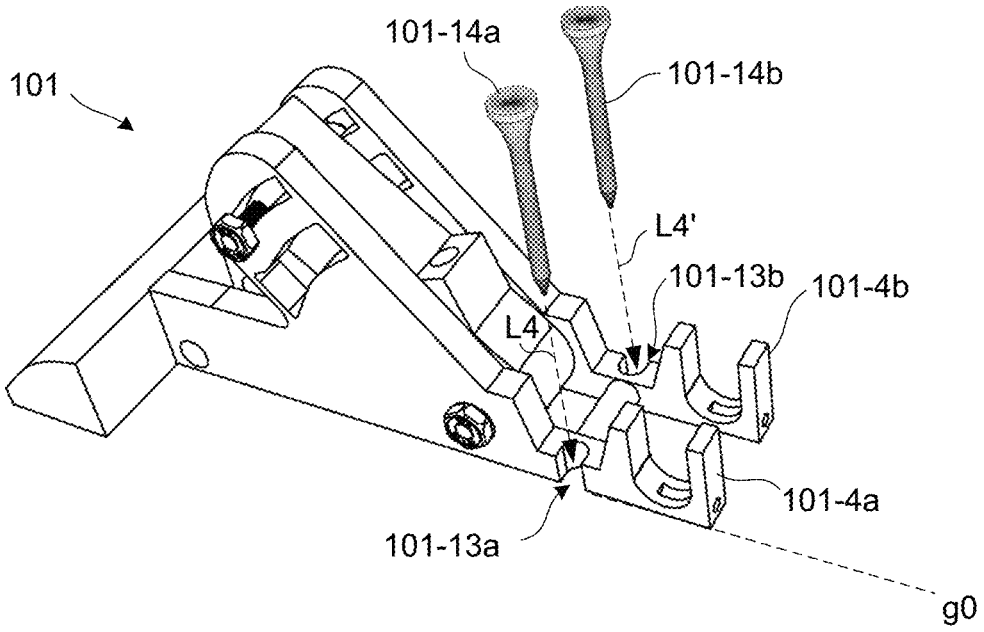
FIG. 9A-FIG. 9B illustrate perspective views of the base support 101 having golf tee members for securing the base support to the ground, in accordance to an embodiment.
Figure 9B:
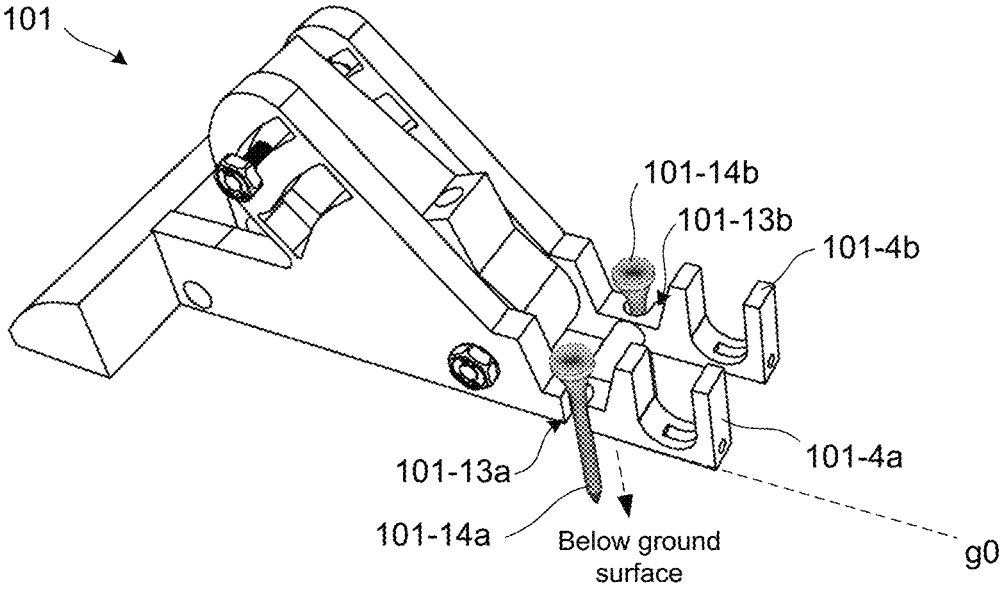

FIG. 9A-FIG. 9B illustrate perspective views of the base support 101 having golf tee members (101-14*a*, 101-14*b*) for securing the base support 101 to the ground, in accordance to an embodiment. Specifically, FIG. 9A illustrates a pre-inserted view of the golf tee members (101-14*a*, 101-14*b*) while FIG. 9B illustrates a post-inserted view of the golf tee members (101-14*a*, 101-14*b*). The golf tee members (101-14*a*, 101-14*b*) may be aligned (lines L4, L4') and inserted through the tee slots (101-13*a*, 101-13*b*) and staked into the ground g0, securing the base support 101 to the ground g0. In practice, the golf tee members (101-14*a*, 101-14*b*) are designed to be applied to grass or a natural playing field, not artificial turf fields or training platforms. Since golf tee members (101-14*a*, 101-14*b*) are common and standard golf accessories that are easily carried by the golfer, this implementation provides the golfer a practical, advantageous, and useful solution for securing the base support 101 to the ground without the need of having to store or carry additional equipment.

Figure 10B:
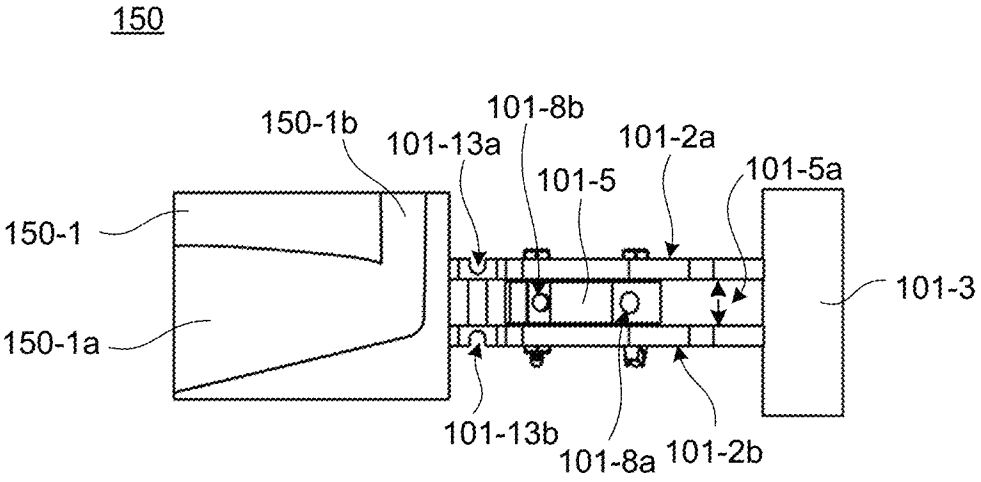
FIG. 10A-FIG. 10D illustrate a front, top, side, and perspective views, respectively, of a base support having another type of golf club insert member, in accordance to an embodiment.
Figure 10D:
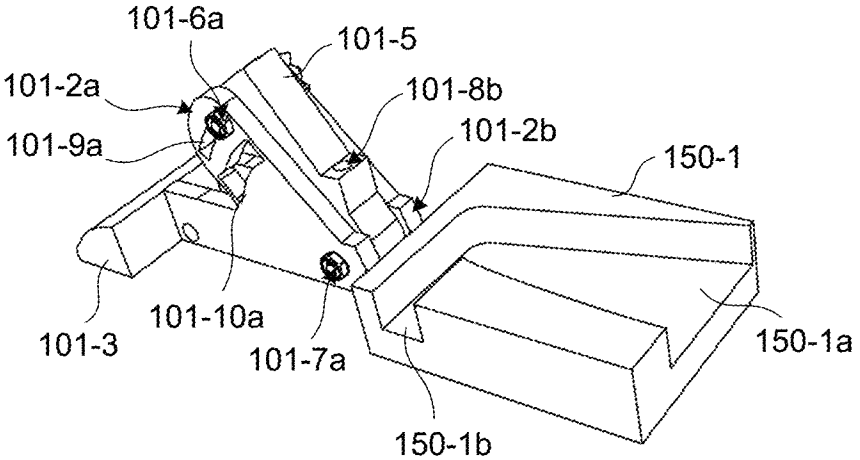
Figure 10A:
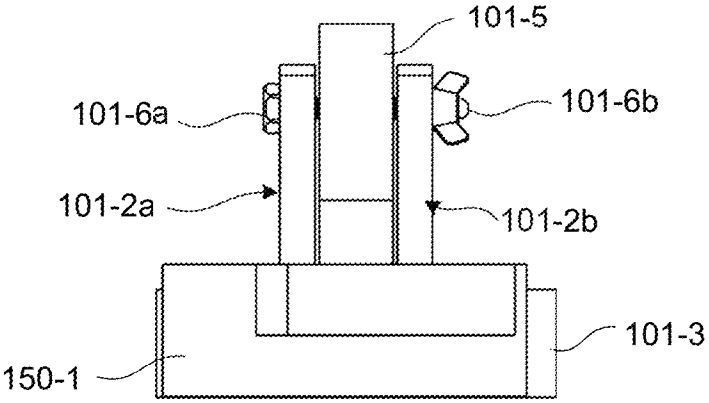
Figure 10C:
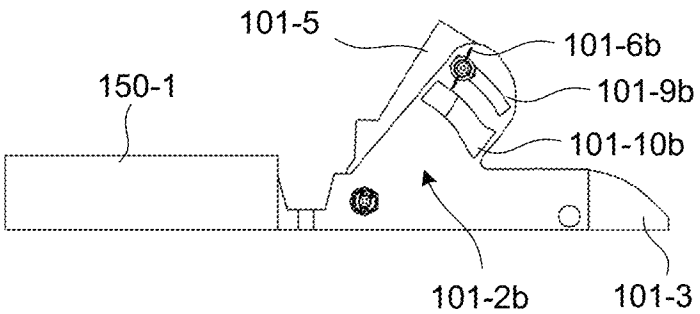

FIG. 10A-FIG. 10D illustrate a front, top, side, and perspective views, respectively, of a base support 150 having another type of golf club insert member 150-1, in accordance to an embodiment. The base support 150 in this implementation have many similar components and elements already described in the previous embodiment, where identical reference numbers indicate similar components and new references numbers indicate new components related specifically to the base support 150. As shown in FIG. 10A (front view), the pivoting swing arm member 101-5 may be fastened and secured to the swing arm support members (101-2*a*, 101-2*b*) via swing adjustment fasteners (101-6*a*, 101-6*b*) and pivot fasteners (101-7*a*, 101-7*b*), which may include fasteners such as threaded bolts, wing nuts, threaded screws, carriage bolts, socket screws, hex bolts or other types of threaded nuts and bolts. As shown in FIG. 10B (top view), the pivoting swing arm member 101-5 may be disposed between a gap 101-5*a* separating the first swing arm support member 101-2*a* from the second swing arm support member 101-2*b*. In addition, the pivoting swing arm member 101-5 may include a primary slot 101-8*a* and a secondary slot 101-8*b* into which the primary alignment rod 103*a* and the secondary alignment rod 103*b* are inserted, respectively. In practice, both the primary alignment rod 103*a* and the secondary alignment rod 103*b* are not permanently attached to the slots (101-8*a*, 101-8*b*) so that they can be easily removed or inserted into the slots by the golfer when performing specific golf swing aid training techniques. In this embodiment, the base support 150 may include a golf club insert member 150-1 coupling the swing arm support members (101-2*a*, 101-2*b*) near the pivot fasteners (101-7*a*, 101-7*b*). The golf club insert member 150-1 in this embodiment has a shape and size that matches a clubface of a golf club. As shown in FIG. 10D, the shape of a golf clubface is shown to be slightly recessed into golf club insert member 150-1 forming a golf clubface channel 150-1*a* and a shaft channel 150-1*b* therein.

Figure 11:
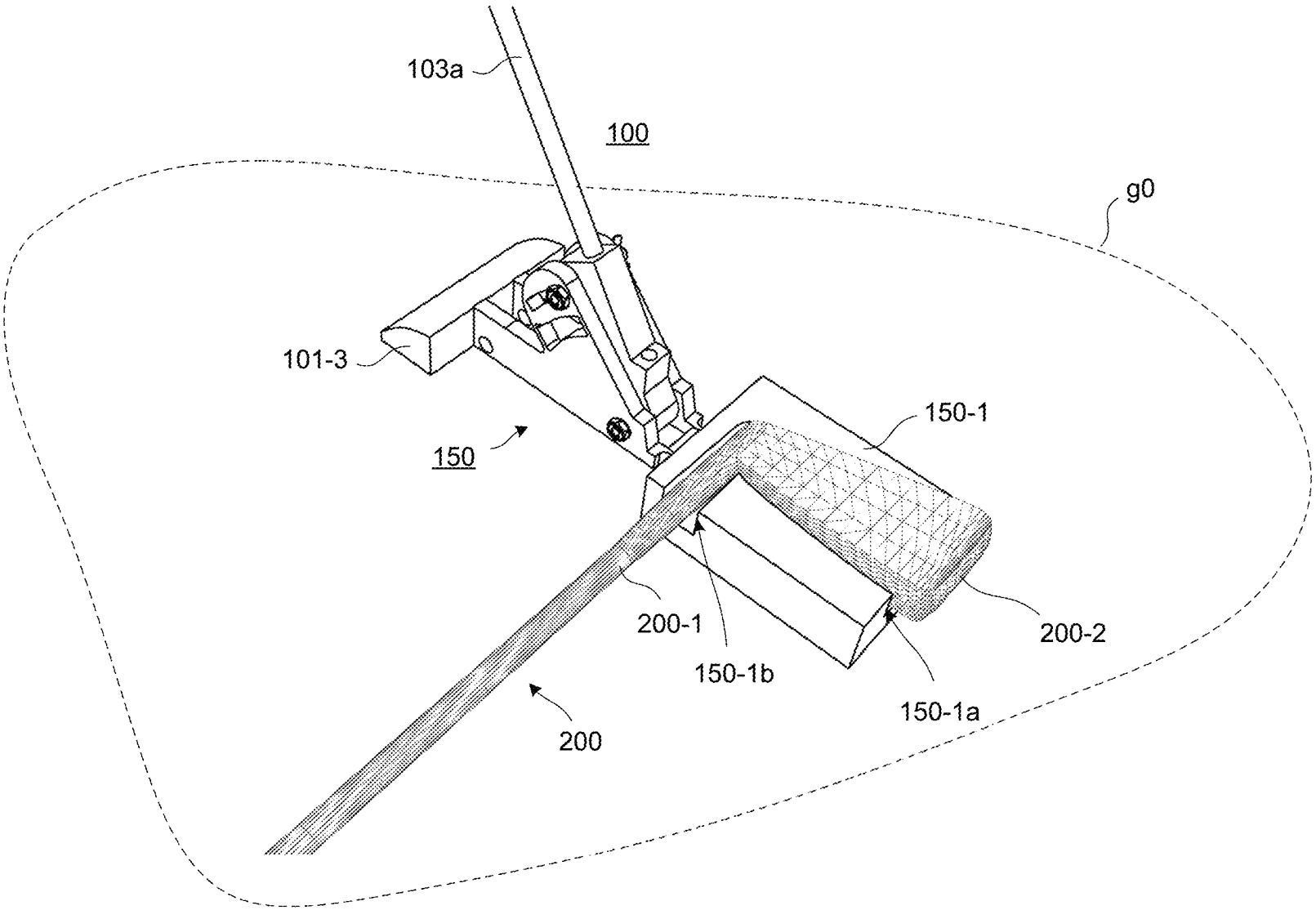
FIG. 11 illustrates another implementation of adding a golf club as a weight to stabilize and hold the base support, in accordance to an embodiment.

FIG. 11 illustrates another implementation of adding a golf club 200 as a weight to stabilize and hold the base support 150, in accordance to an embodiment. The golf club 200 may be any type of golf club (woods, irons, hybrids, wedges, putters, etc.) having a shaft 200-1 and clubface 200-2. In operation, the shaft member 200-1 near the clubface 200-2 of the golf club 200 may be inserted into the shaft channel 150-1*b* while the clubface 200-2 of the golf club 200 may be inserted into the clubface channel 150-1*a* with the golf club 200 resting flat to the ground (g0).

Figure 12:
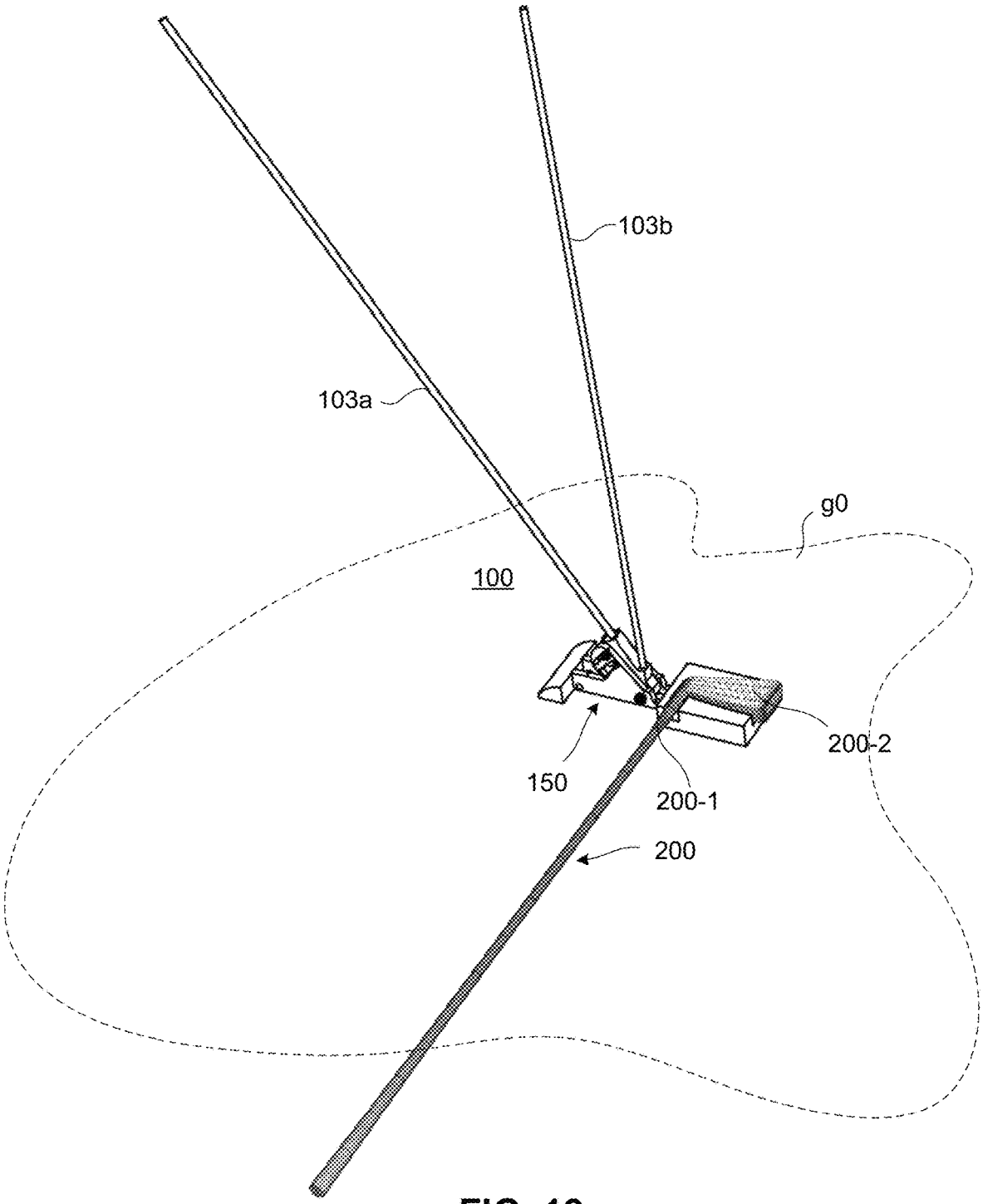
FIG. 12 illustrates a full perspective view of the swing plane training device with the golf club acting as a weight to anchor and stabilize the base support and alignment rods.

FIG. 12 illustrates a full perspective view of the swing plane training device 100 with the golf club 200 acting as a weight to hold and stabilize the base support 150 and alignment rods (103*a*, 103*b*). Similar to the previous embodiment, the advantages of this swing plane training device configuration includes: 1) it allows the base support 150 to be lighter in weight and therefore easier to carry by the golfer; 2) allows the golfer to use an extra golf club as a weight to hold the base support 150; and 3) does not require additional weights or parts for the golfer to carry in their golf bag. In other words, the swing plane training device 100 described in herein has the advantage of using the golf club 200 as a weight to firmly hold the base support 150 and stabilize the swing plane training device 100, the primary alignment rod 103*a*, and/or the secondary alignment rod 103*b*, allowing the swing plane training device 100 to be portable and lightweight in design.

Figure 13A:
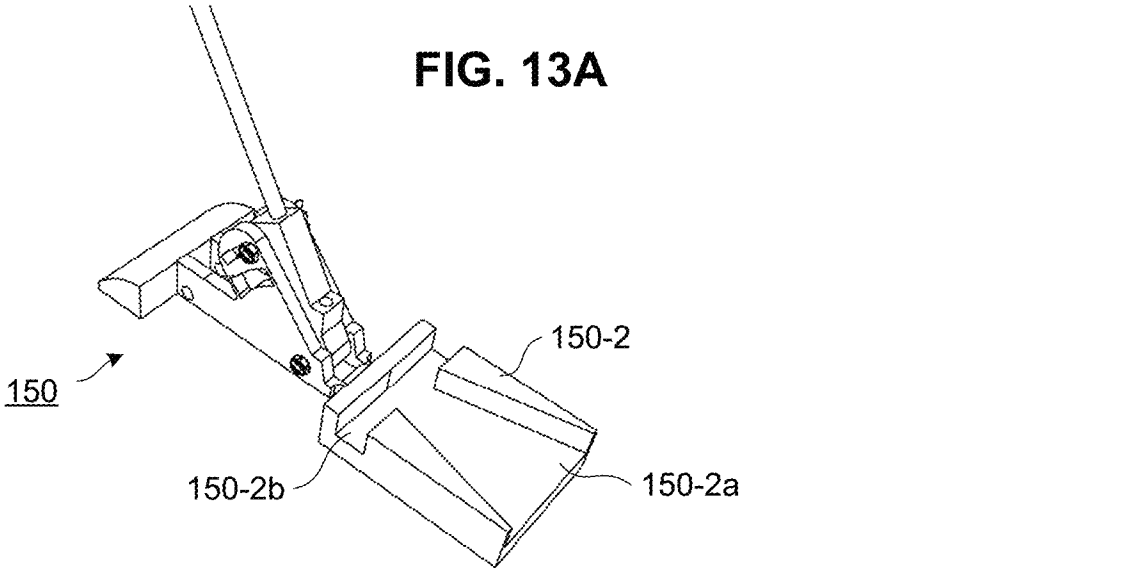
FIG. 13A-FIG. 13C illustrate top perspective views of the base support having yet another type of golf club insert member, in accordance to an embodiment.
Figure 13C:
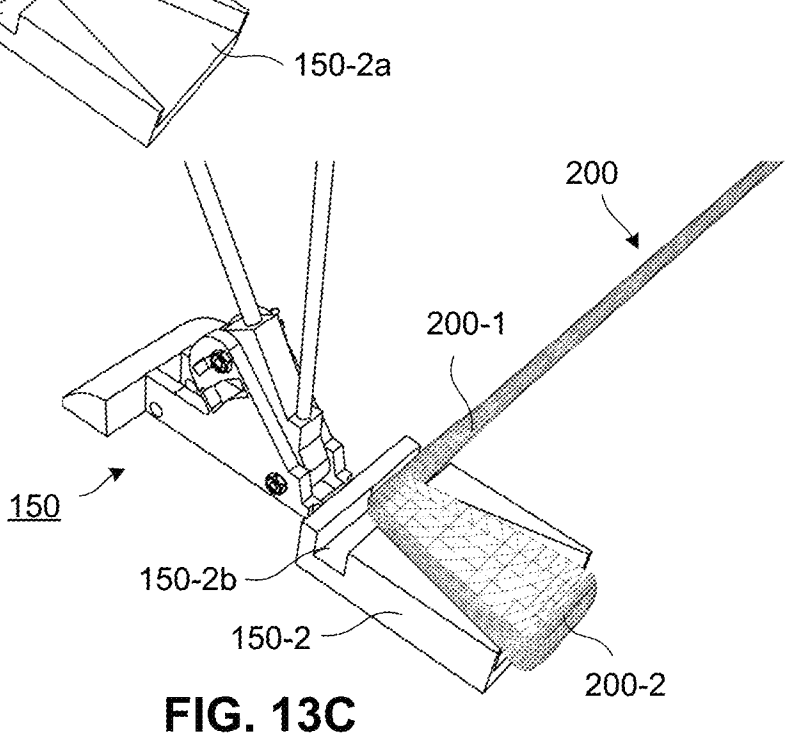
Figure 13B:
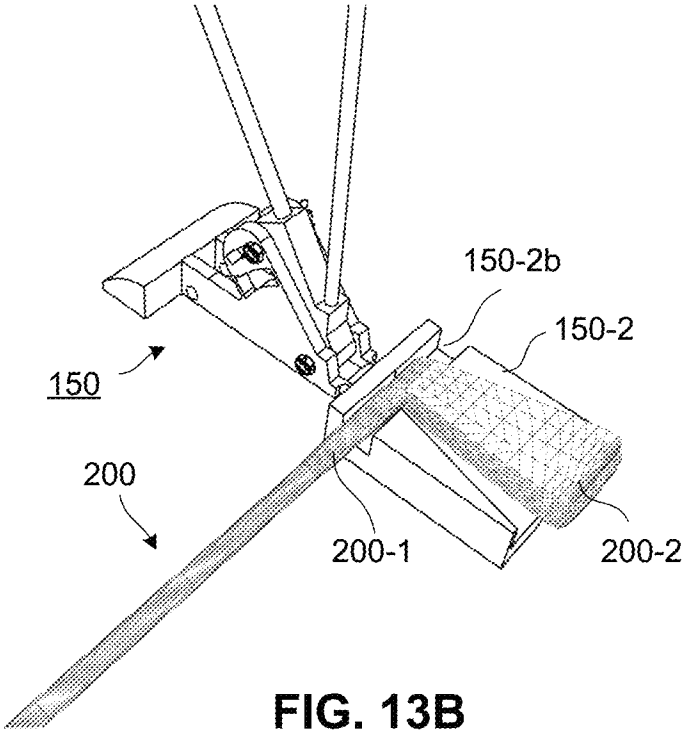

FIG. 13A-FIG. 13C illustrate top perspective views of the base support 150 having yet another type of golf club insert member 150-2, in accordance to an embodiment. The golf club insert member 150-2 in this implementation is similar in design to the previous embodiment, having a recessed area in the shape of a golf clubface. However, in this embodiment, the golf club insert member 150-2 includes a wider clubface slot 150-2*a* and a pass-through slot 150-2*b* formed in the base support 150. The pass-through slot 150-2*b* has includes a rectangular slot extending through the short end of the base support 150. In operation, both the pass-through slot 150-2*b* and the wider clubface slot 150-2*a* allows the golfer to set the golf club 200 in a left facing direction or a right facing direction relative and perpendicular to the base support 150.

Figure 14:
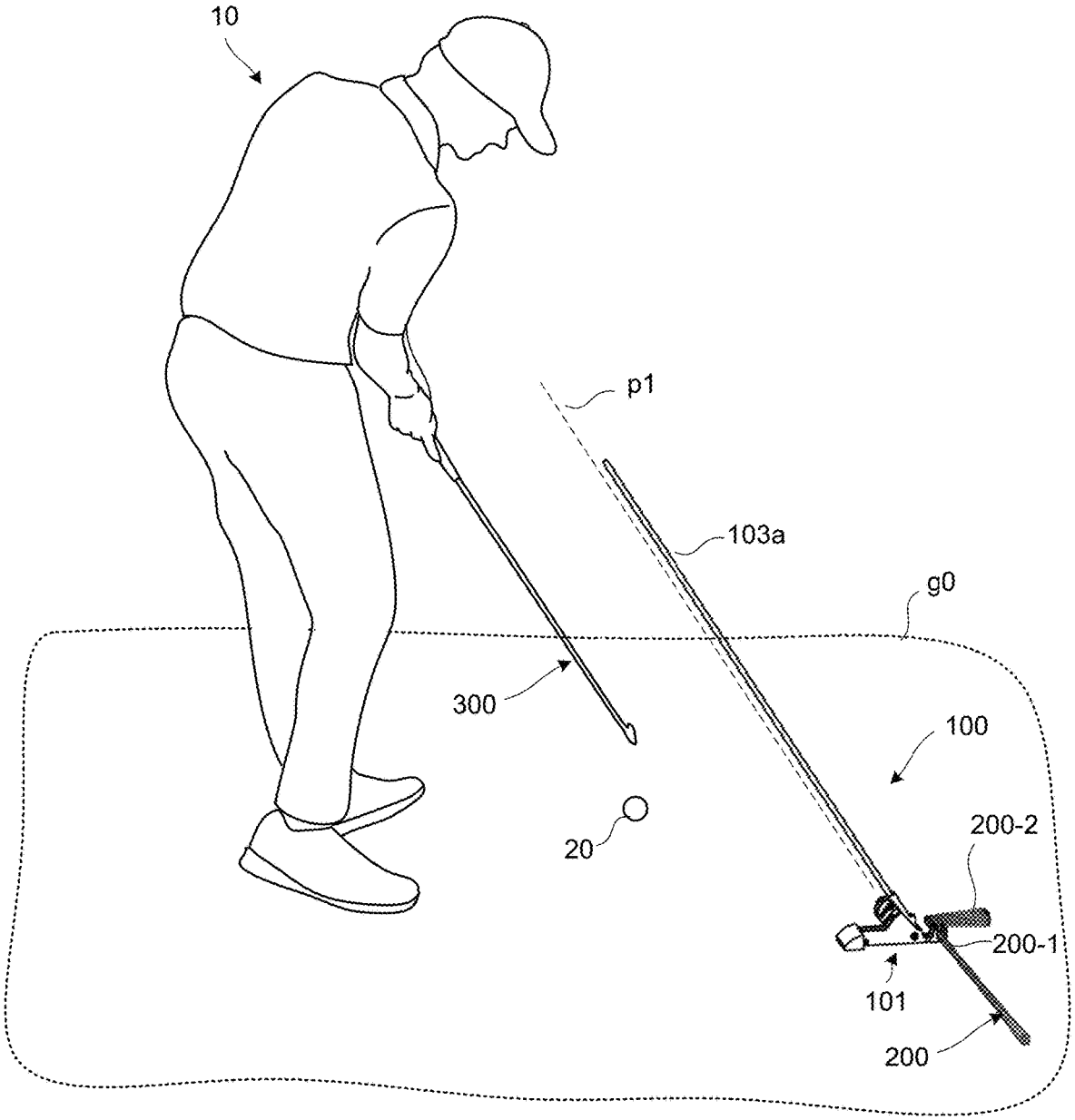
FIG. 14 illustrates a full size view of a golfer swinging a golf club at a swing position, a golf ball, and the swing plane training device.

FIG. 14 illustrates a full size view of a golfer 10 swinging a golf club 300 at a swing position, a golf ball 20, and the swing plane training device 100. In practice, the device 100 may be positioned behind the golfer 10 with the primary alignment rod 103*a* set at an angle to create the visual reference of a swing plane p1. The swing plane training device 100 is held to the ground by another golf club 200 resting within the golf club insert member (101-4*a*, 101-4*b*, 101-4*c*). Golfer can practice the swings by swinging the golf club 300 inside, or underneath, the primary alignment rod 103*a*.

Figure 15:
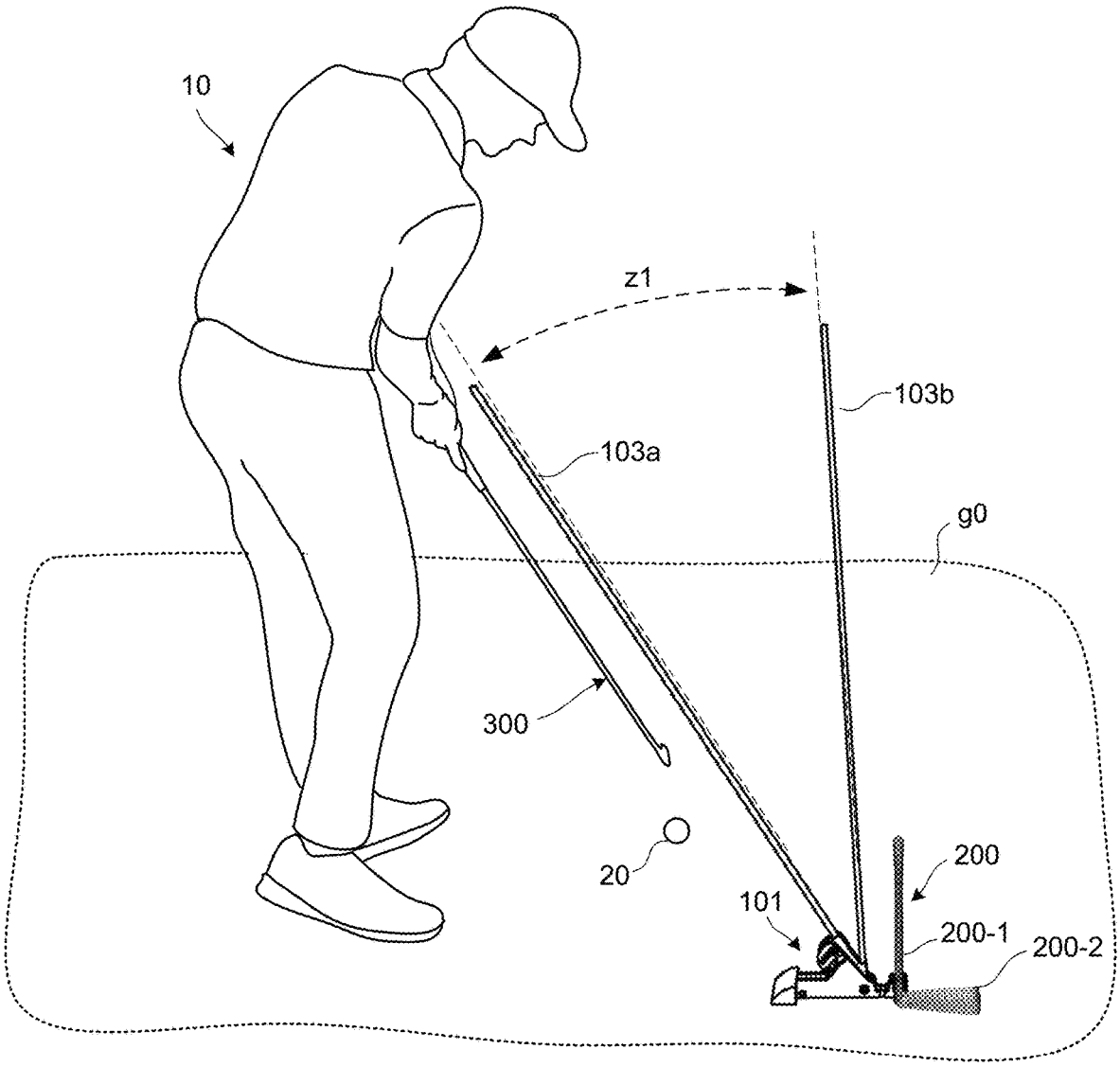
FIG. 15 illustrates a full size view of the golfer at or near address position with the swing plane training device and the golf club acting as a weight to anchor and stabilize the base support.

FIG. 15 illustrates a full size view of the golfer 10 at or near address position with the swing plane training device 100 and the golf club 200 acting as a weight to hold and stabilize the base support 101. In practice, the pivoting swing arm member 101-5 can be rotated at adjustable angles to position the primary alignment rod 103*a* and secondary alignment rod 103*b*, creating a visual feedback of a swing plane, while creating a cone, corridor, or zone z1 through which can be used for swinging the golf club 300. The golfer can position the swing plane training device 100 in several other ways to practice specific golf training drills and improve several aspects of the golf swing such as, but not limited to, swing plane, swing path, hand path, body movement, and clubface alignment. Specifically, these drills can help golfers improve faults such as, but not limited to, swinging excessively off-plane, sliding the body, excessively opening or closing the clubface, etc. Overall, the swing plane training device 100 can be positioned anywhere around the golfer to create a new swing pattern and help the golfer make the necessary change in a short amount of time.

The base support 101, primary alignment rod 103*a*, and the secondary alignment rod 103*b* of the swing plane training device 100 may be fabricated from various manufacturing processes, including but not limited to injection molding techniques, 3D printing techniques, metal fabrication, or wood shaping and cutting techniques. To maintain a lightweight design, the materials and compositions of the base support and alignment rods may include natural materials such as low density woods or softwoods, including balsa and cedar, or synthetic materials such as low density polyethylene, carbon-fiber, fiber-glass or other lightweight composite materials.

In sum, a primary benefit and advantage of the swing plane training device 100 is its ability to provide golfers a portable, lightweight and simple training device that utilizes existing golf equipment (i.e., an extra golf club and tees) to provide support and stability to the swing plane training device, providing golfers space savings and lighter carrying loads.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present disclosure. Although the present disclosure has been shown and described with respect to several preferred embodiments thereof, various changes, omissions, and additions to the form and detail thereof, may be made therein, without departing from the spirit and scope of the disclosure. It is understood that the words which have been used herein are words of description and illustration, rather than words of limitation. Changes may be made, within the purview of the appended claims, as presently stated and as amended, without departing from the scope and spirit of the present disclosure in its aspects.

Other embodiments and modifications of the present disclosure may occur to those of ordinary skill in the art in view of these teachings. Accordingly, the disclosure is to be limited only by the following claims which include all other such embodiments and modifications when viewed in conjunction with the above specifications and accompanying drawings.

What is claimed is:

1. A golf swing plane training aid device for use on a golf playing surface comprising:

a base support having a first swing arm support member, a second swing arm support member, a cross-bar member coupling a first end of the first swing arm support member to a first end of the second swing arm support member, a golf club insert member coupling a second end of the first swing arm support member to a second end of the second swing arm support member, and a pivoting swing arm member disposed between a gap separating the first swing arm support member from the second swing arm support member, wherein the pivoting swing arm member includes a primary slot disposed on a first end of the pivoting swing arm member, wherein the golf club insert member includes channel members for receiving a golf club, wherein the golf club, when applied to the channel members, stabilizes and holds the golf swing plane training aid device to the golf playing surface; and a primary alignment rod detachably coupled to the primary slot of the pivoting swing arm member.

2. The golf swing plane training aid device of claim 1, wherein the pivoting swing arm member includes a secondary slot disposed on a second end of the pivoting swing arm member.

3. The golf swing plane training aid device of claim 2, wherein a secondary alignment rod is detachably coupled to the secondary slot of the pivoting swing arm member.

4. The golf swing plane training aid device of claim 3, wherein the first alignment rod and the secondary alignment rod creates a visual zone of a swing plane, providing a visual reference to guide and train a golfer.

5. The golf swing plane training aid device of claim 1, wherein the pivoting swing arm member is fastened and secured to the first swing arm support member and the second swing arm support member via swing adjustment fasteners and pivot fasteners.

6. The golf swing plane training aid device of claim 5, wherein the pivoting swing arm member is adjusted to a predetermined angle setting by loosening the swing adjustment fasteners and then rotating the pivoting swing arm member about the pivot fasteners.

7. The golf swing plane training aid device of claim 1, wherein the first swing arm support member or the second swing arm support member includes an indicia indicating an angle range setting of the pivoting swing arm member relative to a ground level on which the base support sits.

8. The golf swing plane training aid device of claim 7, wherein the angle range setting has a range that is approximately between 40-60 degrees.

9. The golf swing plane training aid device of claim 1, wherein the base support includes tee slots disposed along second end of the first swing arm support member and the second end of the second swing arm support member.

10. The golf swing plane training aid device of claim 9, wherein golf tee members are inserted into the tee slots, anchoring the base support to the golf playing surface.

11. The golf swing plane training aid device of claim 1, wherein the base support includes tee slots disposed along second end of the first swing arm support member and the second end of the second swing arm support member.

12. The golf swing plane training aid device of claim 11, wherein golf tee members are inserted into the tee slots, anchoring the base support to the golf playing surface.

13. A golf swing plane training aid device for use on a golf playing surface comprising:

a base support having a first swing arm support member, a second swing arm support member, a cross-bar member coupling a first end of the first swing arm support member to a first end of the second swing arm support member, a golf club insert member coupling a second end of the first swing arm support member to a second end of the second swing arm support member, and a pivoting swing arm member disposed between a gap separating the first swing arm support member from the second swing arm support member, wherein the pivoting swing arm member includes a primary slot disposed on a first end of the pivoting swing arm member, wherein the golf club insert member includes a golf clubface channel member for receiving a clubface of a golf club, wherein the golf club, when applied to the golf clubface channel member, stabilizes and holds the golf swing plane training aid device to the golf playing surface; and a primary alignment rod detachably coupled to the primary slot of the pivoting swing arm member.

14. The golf swing plane training aid device of claim 13, wherein the pivoting swing arm member includes a secondary slot disposed on a second end of the pivoting swing arm member.

15. The golf swing plane training aid device of claim 14, wherein a secondary alignment rod is detachably coupled to the secondary slot of the pivoting swing arm member.

16. The golf swing plane training aid device of claim 15, wherein the first alignment rod and the secondary alignment rod creates a visual zone of a swing plane, providing a visual reference to guide and train a golfer.

17. The golf swing plane training aid device of claim 13, wherein the pivoting swing arm member is fastened and secured to the first swing arm support member and the second swing arm support member via swing adjustment fasteners and pivot fasteners.

18. The golf swing plane training aid device of claim 17, wherein the pivoting swing arm member is adjusted to a predetermined angle setting by loosening the swing adjustment fasteners and then rotating the pivoting swing arm member about the pivot fasteners.

19. The golf swing plane training aid device of claim 13, wherein the first swing arm support member or the second swing arm support member includes an indicia indicating an angle range setting of the pivoting swing arm member relative to a ground level on which the base support sits.

20. The golf swing plane training aid device of claim 19, wherein the angle range setting has a range that is approximately between 40-60 degrees.

* * * * *